US007861620B2

(12) United States Patent
Arnold et al.

(10) Patent No.: US 7,861,620 B2
(45) **Date of Patent: *Jan. 4, 2011**

(54) RATCHET WRENCH

(75) Inventors: Robert L. Arnold, Wrightsville, PA (US); Richard P. Folkenroth, York, PA (US)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/963,075

(22) Filed: Dec. 21, 2007

(65) Prior Publication Data

US 2008/0092696 A1 Apr. 24, 2008

Related U.S. Application Data

(63) Continuation of application No. 11/038,313, filed on Jan. 19, 2005, now Pat. No. 7,311,019, which is a continuation of application No. 10/755,434, filed on Jan. 12, 2004, now abandoned, which is a continuation of application No. 10/102,433, filed on Mar. 19, 2002, now Pat. No. 6,711,973.

(51) Int. Cl.
*B25B 13/46* (2006.01)

(52) U.S. Cl. ..... 81/63.2; 81/63

(58) Field of Classification Search ..... 81/61–63.2
See application file for complete search history.

(56) References Cited

U.S. PATENT DOCUMENTS

| | | | | |
|---|---|---|---|---|
| 2,957,377 A | | 10/1960 | Hare | |
| 3,265,171 A | | 8/1966 | Kllness | |
| 4,934,220 A | | 6/1990 | Slusar et al. | |
| 5,157,994 A | | 10/1992 | Krivec | |
| 5,178,047 A | | 1/1993 | Arnold et al. | |
| 6,125,722 A | | 10/2000 | Hopper, Jr. et al. | |
| 6,161,454 A | * | 12/2000 | Chaconas | 81/63.2 |
| 6,164,167 A | * | 12/2000 | Chen | 81/63.2 |
| 6,230,591 B1 | * | 5/2001 | Ling et al. | 81/63 |
| 6,237,447 B1 | * | 5/2001 | Chen et al. | 81/63.1 |
| 6,253,647 B1 | * | 7/2001 | Eggert et al. | 81/63 |
| 6,282,992 B1 | | 9/2001 | Hu | |
| 6,295,896 B1 | | 10/2001 | I-He | |
| 6,435,062 B1 | | 8/2002 | McCann | |
| 6,732,614 B2 | | 5/2004 | Hu | |
| 7,353,735 B2 | | 4/2008 | Patel et al. | |
| 2002/0112573 A1 | * | 8/2002 | Hu | 81/63.2 |

* cited by examiner

*Primary Examiner*—D. S Meislin
(74) *Attorney, Agent, or Firm*—Nelson Mullins Riley & Scarborough, LLP

(57) ABSTRACT

A ratchet wrench has a through cavity in which a reversing lever is disposed. The reversing lever has a pair of protruding lips formed thereon opposite from one another. A cooperating ledge is formed on the head in the cavity and on the pawl which is adjacent to the reversing lever. A spring-loaded pusher is disposed longitudinally in a blind bore in the reversing lever and the pusher engages a pocket in the pawl. A cover plate is disposed on a shelf recessed on the bottom of the wrench and spaced apart from the reversing lever.

11 Claims, 11 Drawing Sheets

RATCHET WRENCH

The present application is a continuation of application ser. No. 11/038,313, filed Jan. 19, 2005, now U.S. Pat. No. 7,311,019, which is a continuation of application ser. No. 10/755,434, filed Jan. 12, 2004 (now abandoned), which is a continuation of application ser. No. 10/102,433, now U.S. Pat. No. 6,711,973, issued on Mar. 30, 2004, the entire disclosure of each hereby being incorporated by reference in their entirety.

BACKGROUND OF THE INVENTION

1. Field of the Invention

The present invention is directed to a ratchet wrench and more particularly to a ratchet wrench having a spring-loaded pusher carried by a reversing lever and the reversing lever having complementary ledges to retain the reversing lever in the head of the wrench.

2. Description of Related Art

There are numerous patents disclosing ratchet wrenches having a reversing lever and a pawl. Many of these wrenches have a reversing lever which is inserted from the top of the handle. Also, there are many wrenches which have an internal ledge on the handle. U.S. Pat. No. 2,957,377 to Hare discloses one of these devices and U.S. Pat. No. 5,178,047 to Arnold et al. discloses another wrench. Chaconas in U.S. Pat. No. 6,161,454 discloses a ratchet wrench in which a detent means is carried by the reversing lever and engages a pocket in the pawl. The applicant is also aware of the following:

| U.S. Pat. No. | Inventor(s) |
|---|---|
| 4,934,220 | Slusar et al |
| 5,157,994 | Krivec |
| 6,125,722 | Hopper, Jr. et al |

BRIEF SUMMARY OF THE INVENTION

It is an object of the present invention to provide a ratchet wrench in which the reversing lever is retained in the head of the wrench by two protruding lips formed on the reversing lever.

In accordance with the teachings of the present invention, there is disclosed, in a ratchet wrench, the combination of a handle and a head having a through cavity formed therein from the top to the bottom of the head. A reversing lever is disposed in the through cavity in the head. A spring-loaded pusher is carried by the reversing lever, extending forwardly therefrom, and longitudinally aligned with the handle. A pawl is disposed in the cavity forwardly of the reversing lever and engaged by the spring-loaded pusher. The reversing lever has at least one lip protruding therefrom and cooperating with a complementary ledge formed in the head, thereby precluding upward movement of the reversing lever out of the through cavity.

Further in accordance with the teaching of the present invention, there is disclosed in a ratchet wrench, the combination of a handle and a head having a through cavity formed therein from the top to the bottom of the head. A reversing lever is disposed in the through cavity in the head having a pair of protruding lips disposed substantially diametrically oppositely of each other. A ledge is formed in the head and a ledge is formed on the pawl cooperating with the respective pair of protruding lips on the reversing lever to preclude upward movement of the reversing lever out of the head.

In addition, in accordance with the teachings of the present invention, there is disclosed in a ratchet wrench, the combination of a handle and a head having a through cavity formed therein from the top to the bottom of the head. A reversing lever is disposed in the through cavity in the head. The reversing lever has a front portion which is cut away to accommodate the insertion of the reversing lever into the cavity from the top of the head. A spring-loaded detent is carried by the reversing lever, extending forwardly therefrom, and longitudinally aligned with the handle. A pawl is disposed in the cavity forwardly of the reversing lever and engaged by the spring-loaded pusher. The spring-loaded pusher has a substantially conical tip, and the pawl has a rearward face provided with a pocket for receiving the conical tip of the spring-loaded pusher carried by the reversing lever. The reversing lever has a first rearwardly-protruding lip and a second forwardly-protruding lip. The respective protruding lips are disposed in substantially the same plane. The head has a first ledge disposed above and cooperating with the first lip on the reversing lever. A second ledge is formed on a lower surface of the pawl. The second ledge on the pawl is disposed above and cooperates with the second protruding lip on the reversing lever. In this manner, upward movement of the reversing lever out of the through cavity in the head is precluded. A cover plate is removably secured on a shelf recessed on the bottom of the head, the cover plate being spaced from the reversing lever and serving as a dirt shield.

Also, in accordance with the teachings of the present invention, there is disclosed a ratchet wrench having a handle connected to a head. The head has a through cavity formed therein from a top to a bottom of the head. A reversing lever is disposed in the through cavity in the head. A pawl having teeth is disposed in the cavity forwardly of the reversing lever and contacting the reversing lever. A ratchet gear having teeth is disposed in the cavity forwardly of the pawl, the ratchet gear teeth engaging the pawl teeth. In an improvement, the reversing lever has at least one lip protruding therefrom which cooperates with a complementary ledge formed in the head, thereby precluding upward movement of the reversing lever out of the through cavity. The reversing lever has an arm formed on a top thereof. The arm extends rearwardly of the through cavity and precludes movement of the reversing lever into the through cavity. The bottom of the head has a shelf recessed therein around the periphery of the through opening. A cover plate is disposed on the shelf in the bottom of the head. The cover plate supports the ratchet gear and the pawl and is spaced apart from the reversing lever. A retaining ring secures the cover plate to the head. The cover plate serves as a dirt shield.

Additionally, in accordance with the teachings of the present invention, there is disclosed in a ratchet wrench, the combination of a handle having a head portion provided with a through cavity. A reversing lever is disposed in the through cavity, the reversing lever having a manually-manipulatable lever extending rearwardly of the through cavity and over the handle, thereby precluding downward movement of the reversing lever out of the through cavity. A pawl is disposed forwardly of the reversing lever. A spring-loaded detent is carried by the reversing lever and engages the pawl. First and second lip means on the reversing lever cooperate with first and second shelf means in the head and pawl, respectively, thereby precluding upward movement of the reversing lever out of the through cavity in the head.

Still further in accordance with the teachings of the present invention, there is disclosed in a ratchet wrench, the combination of a handle having a head portion provided with a through cavity. A reversing lever is disposed in the through cavity. A pawl is disposed forwardly of the reversing lever. A spring-loaded detent is carried in a transverse bore in the reversing lever and engaging the pawl. Means are provided for precluding movement of the reversing lever out of the through cavity in the head. An O-ring is disposed in an external annular groove in an upper portion of the reversing lever, and a cover plate is retained on the bottom of the head. The cover plate is spaced from the bottom of the reversing lever and with respect to the reversing lever and functions only to shield dirt from entering into the through cavity in the head.

These and other objects of the present invention will become apparent from a reading of the following specification taken in conjunction with the enclosed drawings.

BRIEF DESCRIPTION OF THE DRAWINGS

FIG. 13 is a perspective view showing the reversing lever tilted and being inserted into the through cavity from the top of the wrench.

FIG. 14 is a partial cut-away view showing the reversing lever in place with the rearwardly extending lip engaged

DESCRIPTION OF THE PREFERRED EMBODIMENTS

Figure 1:
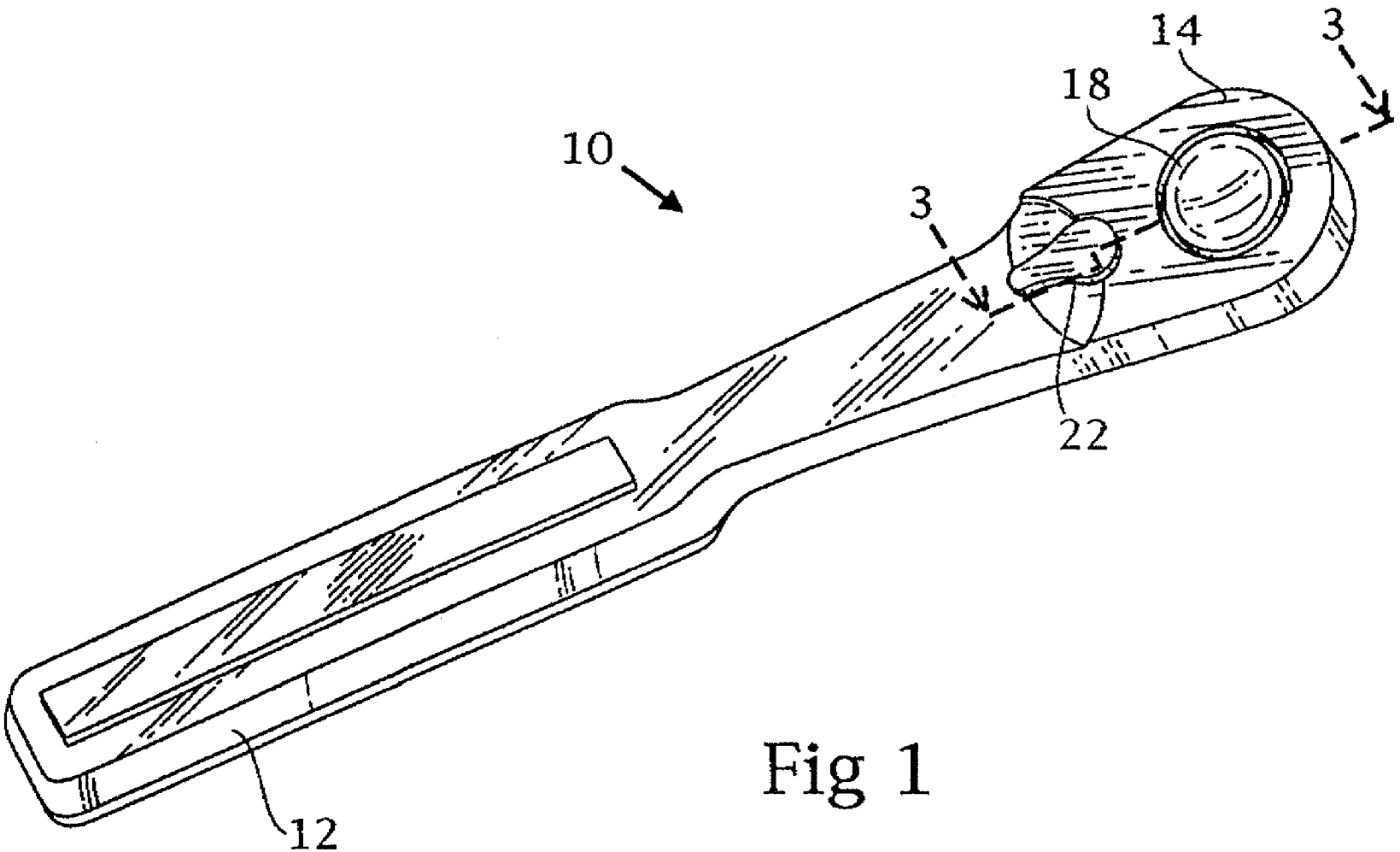
FIG. 1 is a perspective view of the top of the ratchet wrench of the present invention.
Figure 2:
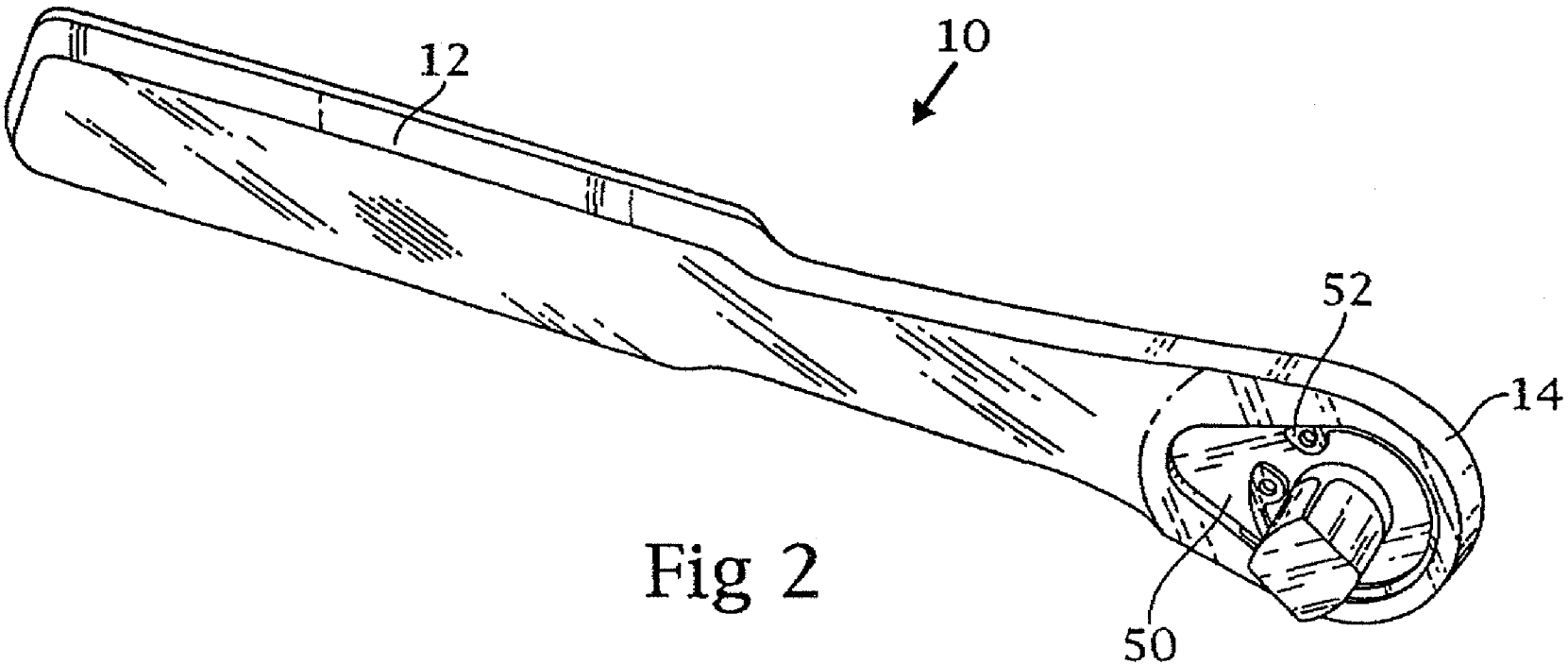
FIG. 2 is a perspective view of the bottom of the present invention.
Figure 3:
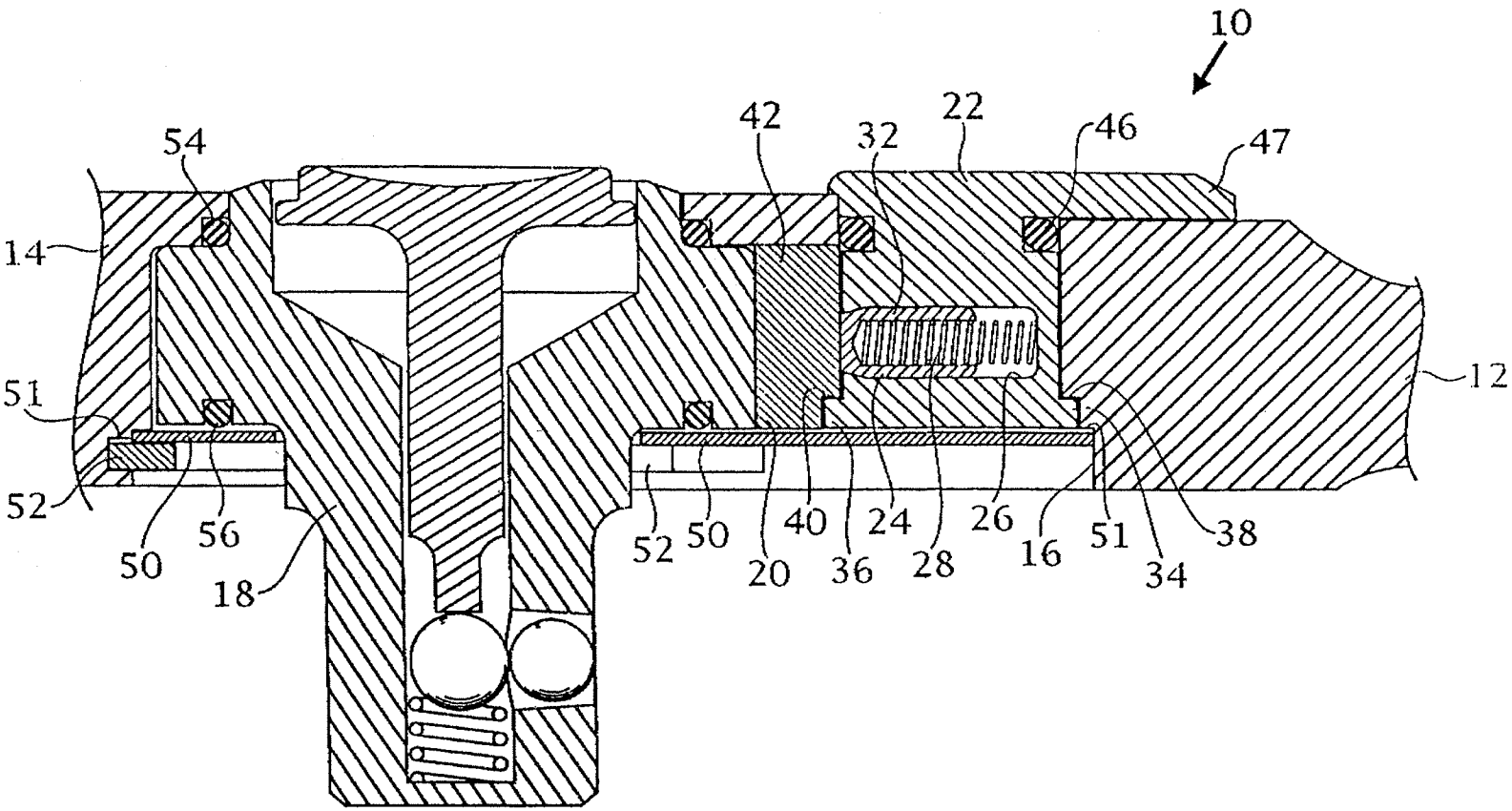
FIG. 3 is a longitudinal section view taken across the lines 3-3 of FIG. 1.
Figure 4:
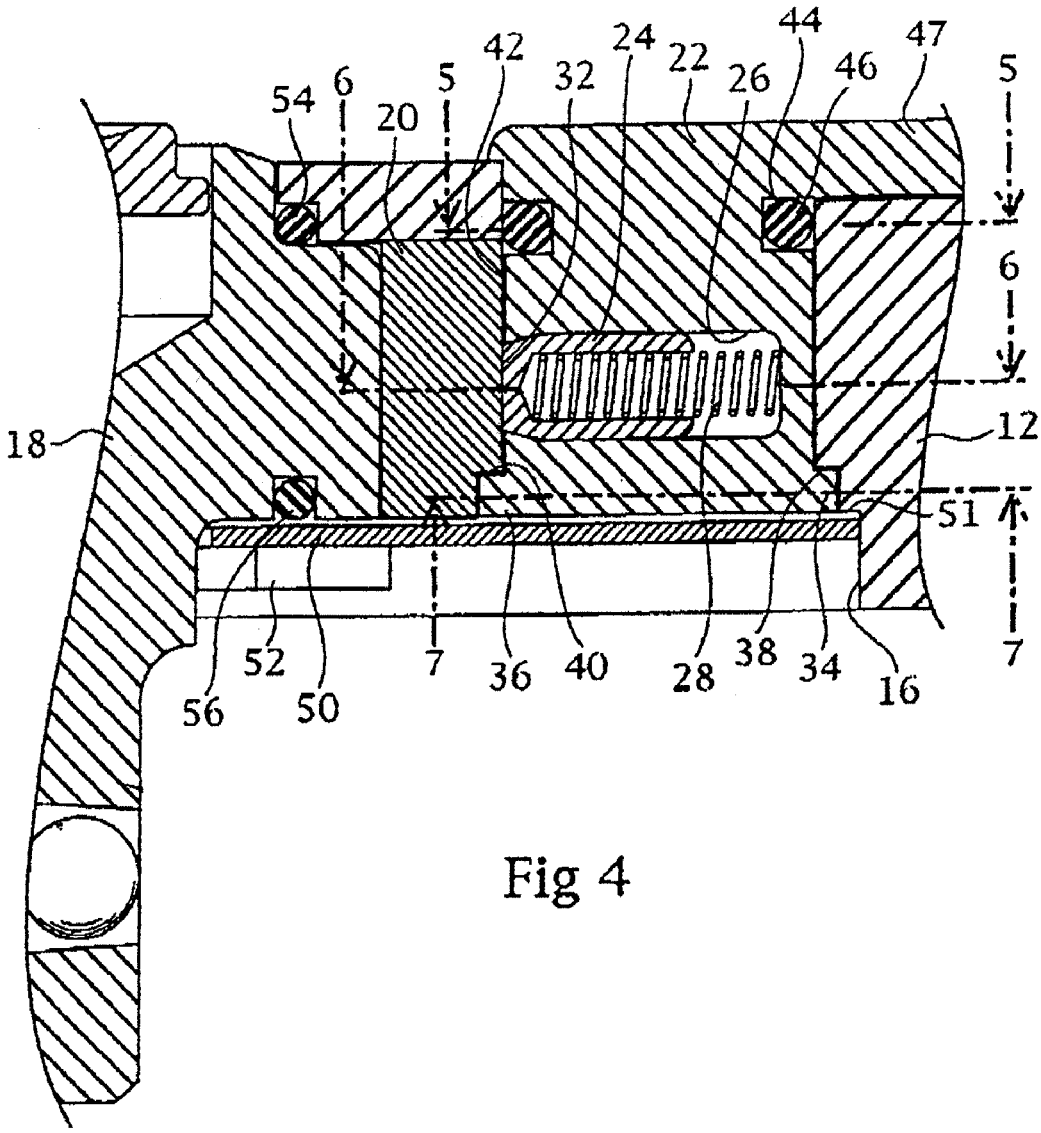
FIG. 4 is an enlarged view of a portion of FIG. 3 showing the reversing lever and pawl.

Referring now to FIGS. 1-12 the present invention is a ratchet wrench 10 having a handle 12 connected to a head 14. A through cavity 16 is formed in the head 14 from the top to the bottom of the handle 12. A ratchet gear 18 is disposed in the through cavity 16 distal from the handle 12. A pawl 20 is disposed in the through cavity 16 between the ratchet gear 18 and the handle 12. Teeth on the pawl 20 cooperate with teeth on the ratchet gear 18. A reversing lever 22 is disposed in the through cavity 16, proximal to the handle 12 and juxtapositioned rearwardly of the pawl 20. A spring-loaded pusher 24 is carried in a blind bore 26 in the reversing lever 22. The pusher 24 extends forwardly of the reversing lever and is aligned longitudinally with the handle. This is distinguished from most ratchet wrenches in which the spring bore is disposed in the handle at an angle with respect to the handle. A spring 28 is disposed in the blind bore 26 in the reversing lever 22 urging the pusher 24 to engage a pocket or depression 30 in the rearward face of the pawl 20. Preferably, the pusher 24 has a conical tip 32 which is received in the pocket 30 in the pawl 20. FIGS. 3 and 4 do not show the conical tip 32 of the pusher 34 due to rotation of the reversing lever 22.

The reversing lever 22 has at least a first rearwardly protruding lip 34 formed thereon. Preferably, there is also formed on the reversing lever 22, a second forwardly protruding lip 36. The respective protruding lips 34, 36 are disposed in substantially the same plane and are diametrically opposite to one another.

Figure 4A:
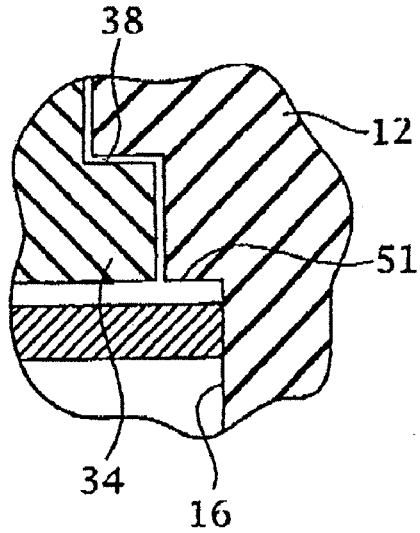
FIG. 4A is an enlarged view of a portion of FIG. 4 showing the interface of the first lip on the reversing lever with the complementary ledge on the head.
Figure 6:
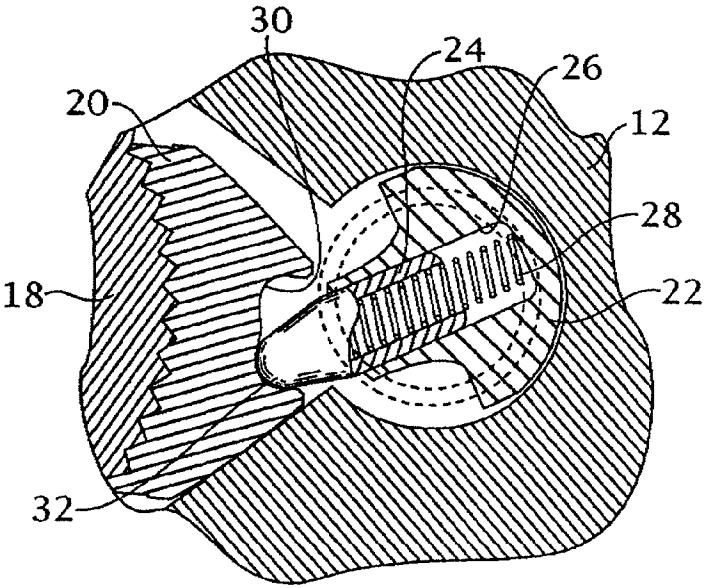
FIG. 6 is a cross-sectional view taken across the lines 6-6 of FIG. 4.
Figure 7:
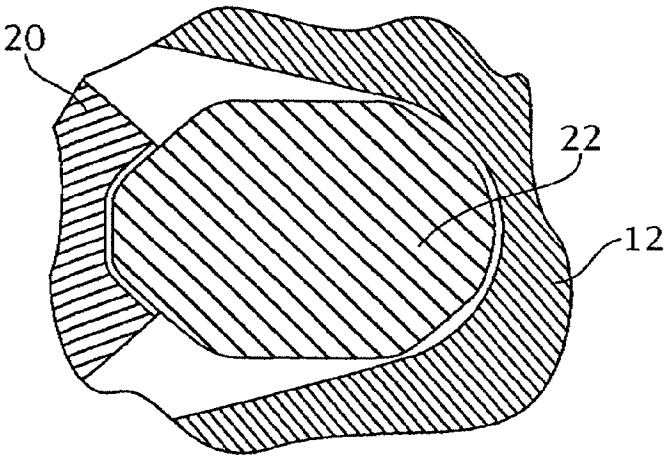
FIG. 7 is a cross-sectional view taken across the lines 7-7 of FIG. 4.
Figure 5:
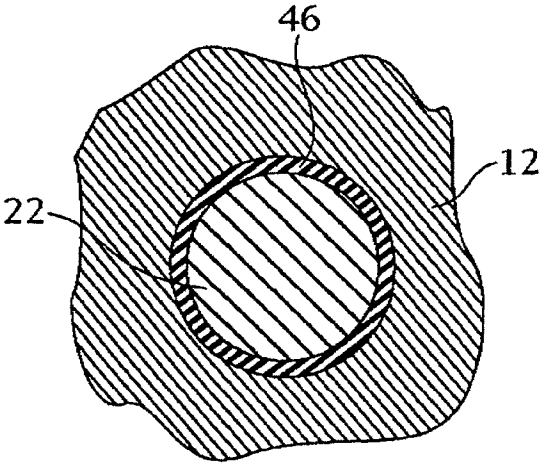
FIG. 5 is a cross-sectional view taken across the lines 5-5 of FIG. 4.
Figure 8:
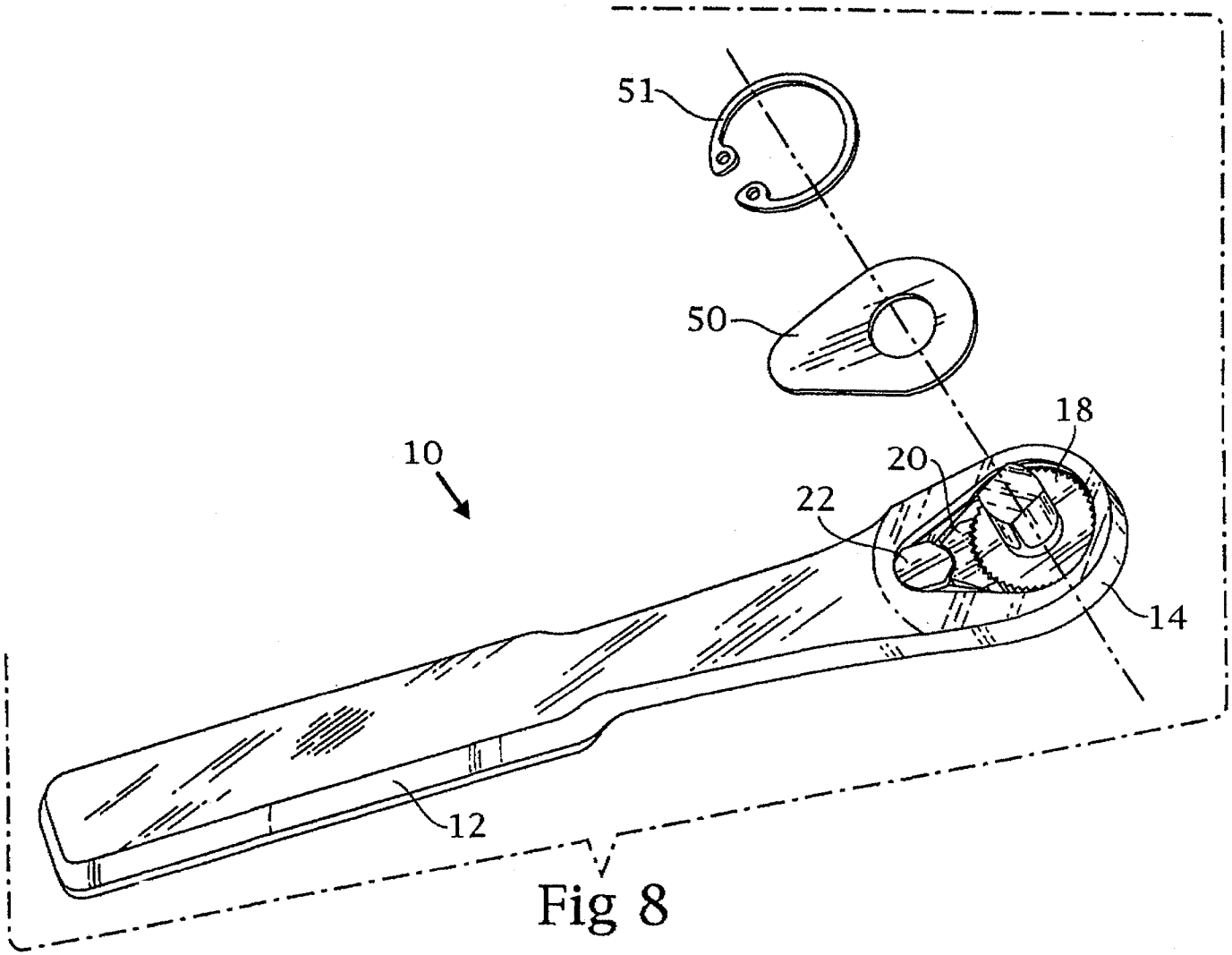
FIG. 8 is a bottom view of the wrench with the cover plate removed.
Figure 9:
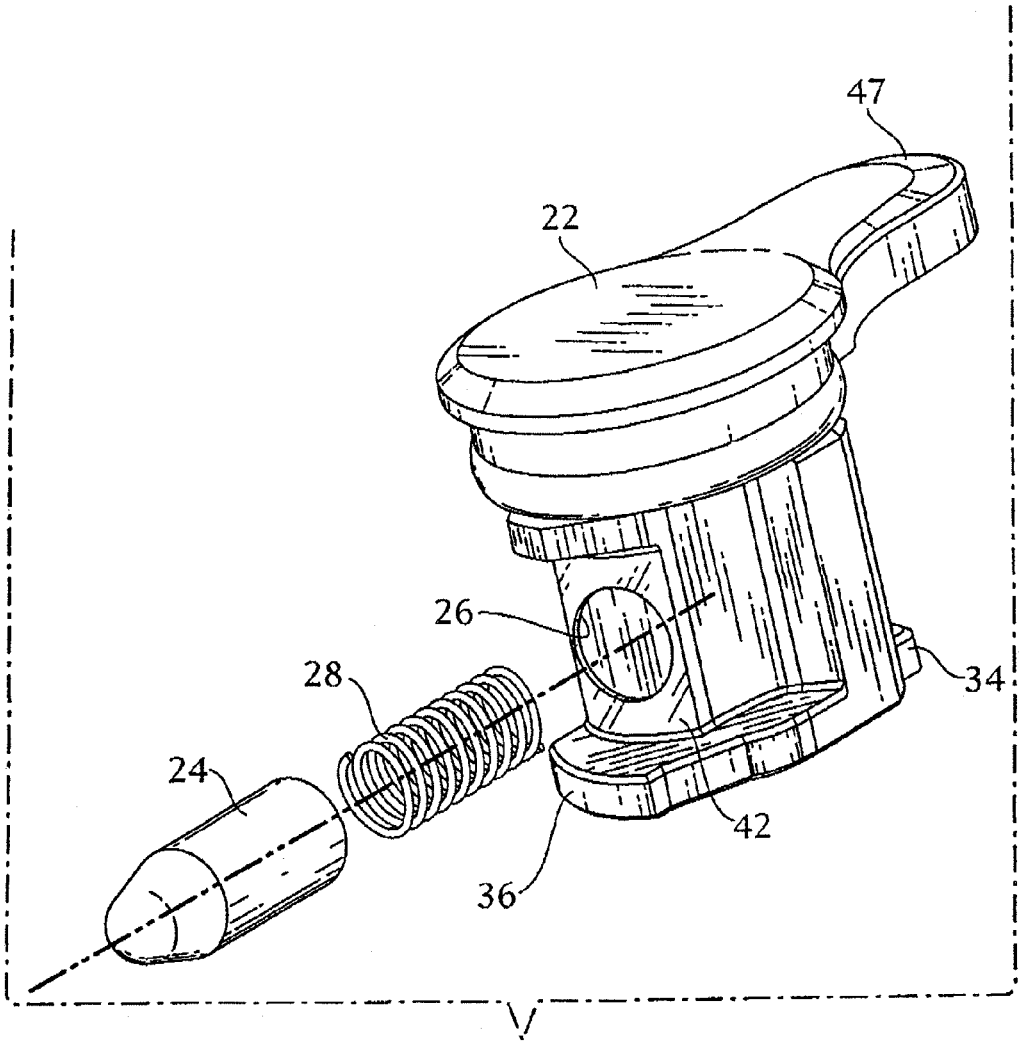
FIG. 9 is a front exploded view of the reversing lever.
Figure 10:
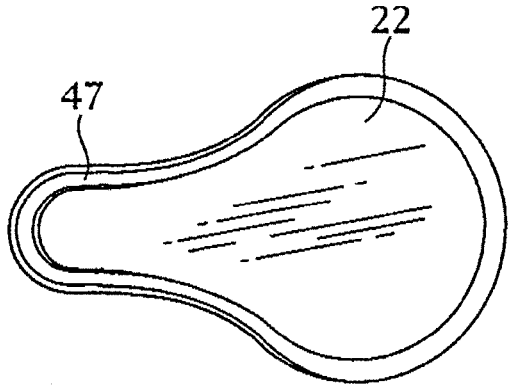
FIGS. 10-12 are orthogonal projection views of the reversing lever.
Figure 11:
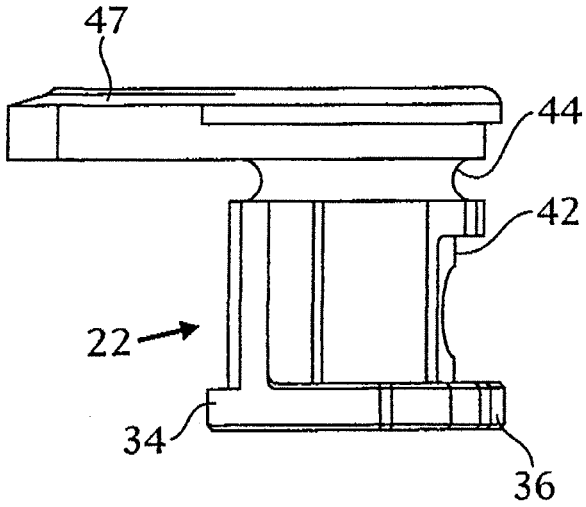
Figure 12:
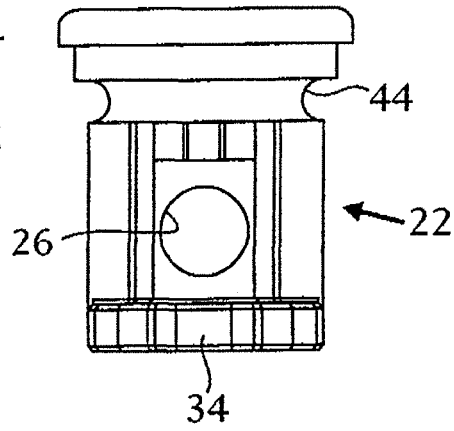

A first complementary ledge 38 is formed in the head 14 and extends into the through cavity 16. The first rearwardly-extending lip 34 on the reversing lever 22 cooperates with the first complementary ledge 38 (FIG. 4A). A second complementary ledge or shelf 40 is formed in a lower surface of the pawl 20. The second forwardly protruding lip 36 cooperates with the second complementary ledge 40.

A front portion 42 of the reversing lever 22 is cut away. The cut-away portion is oriented toward the pawl 20 and surrounds the blind bore 26 in the reversing lever 22.

A groove 44 is formed in the reversing lever 22 and an O-ring 46 is received in the groove 44 such that when the reversing lever 22 is disposed in the through cavity 16. The O-ring 46 forms a seal between the reversing lever 22 and the handle 12 at the upper portion of the through cavity 16.

Figure 13:
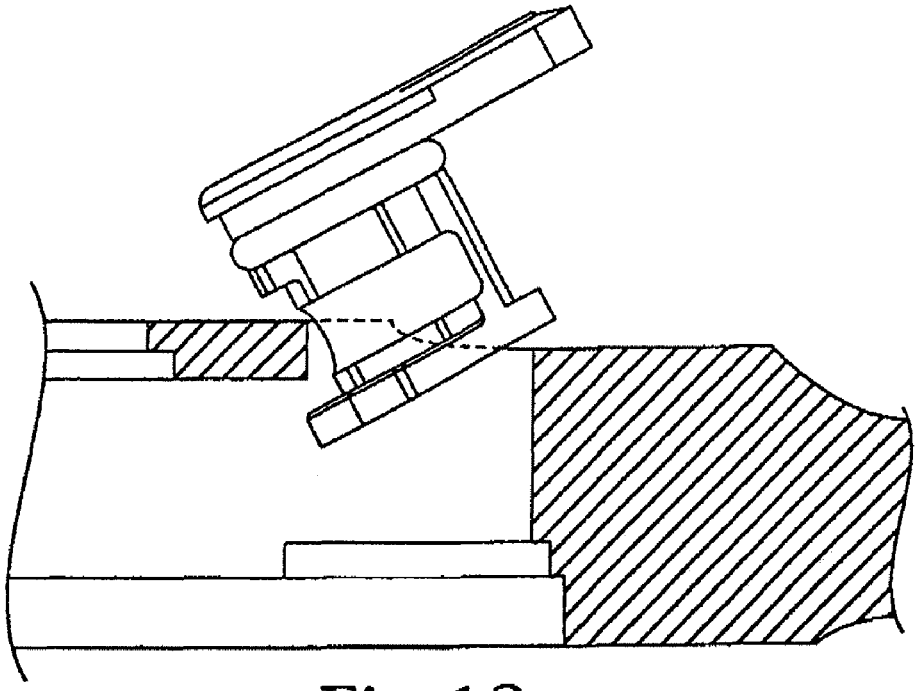
FIGS. 13-14 are a sequence of views showing assembly of the reversing lever.
Figure 14:
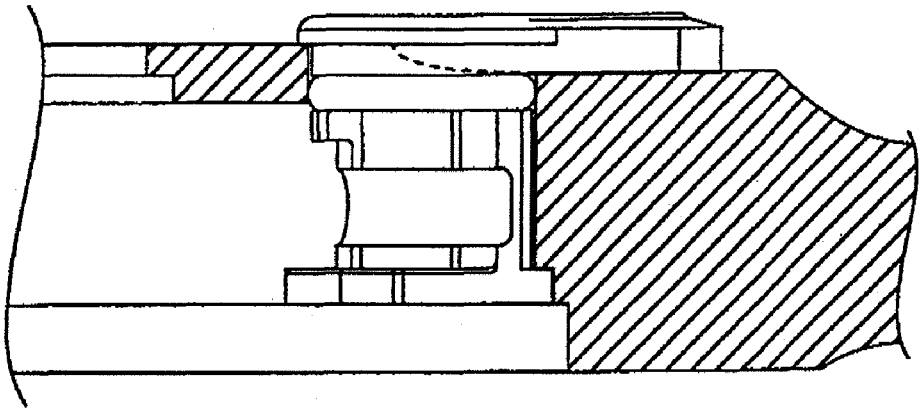
Figure 15A:
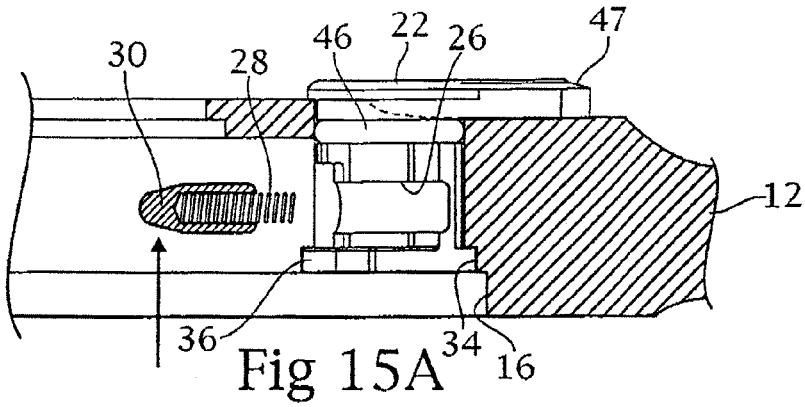
FIGS. 15A-15B are a sequence of partial cut-away views showing insertion of the spring and pusher.
Figure 15B:
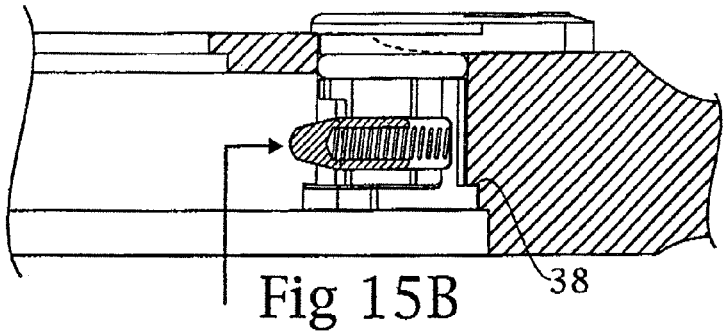

The reversing lever 22 is assembled in the wrench 10 (FIGS. 13-14) by tilting the reversing lever 22 and inserting the protruding lip 36 into the through cavity from the direction of the top of the handle 12 with the first rearward lip 34 directed upwardly away from the through cavity 16. The arm 47 on the reversing lever 22 which is used to manually move the lever 22 is disposed above the handle 12 directed upwardly and rearwardly. The pusher 24 and spring 28 are not in the blind bore 26 during this assembly step. The cut-away front portion 42 of the reversing lever 22 provides clearance from the head of the wrench to facilitate insertion of the reversing lever 22. The first rearwardly extending lip 34 is disposed under the complementary first ledge 38 in the head 14. The reversing lever 22 is seated into place in the through cavity 16 such that the second forwardly extending lip 36 can engage the second complementary ledge 40 on the pawl 20, the first rearwardly extending lip 34 can engage the first complementary ledge on the head 14 and the O-ring 46 on the reversing lever 22 seals the reversing lever 22 with the upper portion of the through cavity 16. The engagement of the lips 34, 36 on the reversing lever 22 with the ledges 38, 40, all prevent upward movement and maintain the reversing lever 22 in the through cavity 16. Actual engagement of the lips 36, 38 occurs when the reversing lever 22 tends to move toward the top of the wrench. The arm 47 on the reversing lever 22 precludes movement of the reversing lever 22 into the through opening 16. The spring 28 and the pusher 24 are inserted into the blind bore 26 in the reversing lever through the bottom of the through cavity 16 (FIGS. 15A-15B).

Figure 16A:
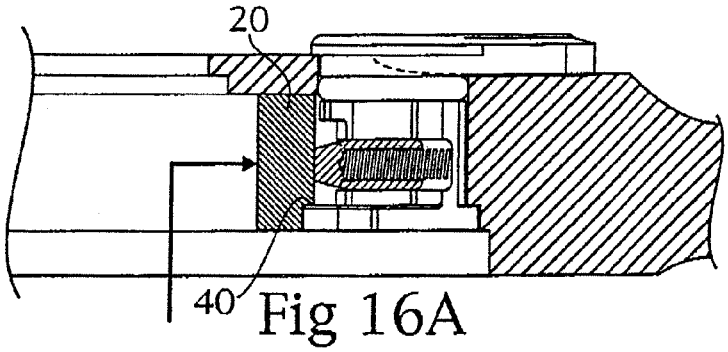
FIGS. 16A-16B are views showing insertion of the pawl and ratchet gear.
Figure 16B:
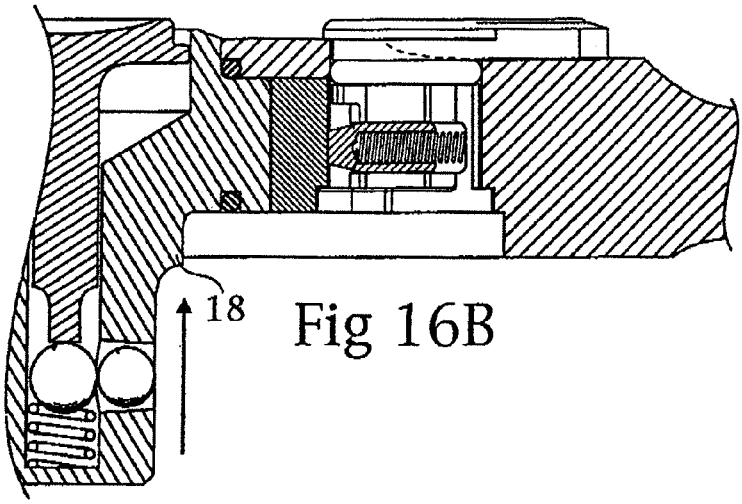

The pawl 20 is inserted into the cavity 16 adjacent to the pusher 24 such that the pusher is received in the pocket 30 in the pawl 20. The ratchet gear 18 is inserted into the forward portion of the head 14 adjacent to the pawl 20 (FIGS. 16A-16B).

Figure 17:
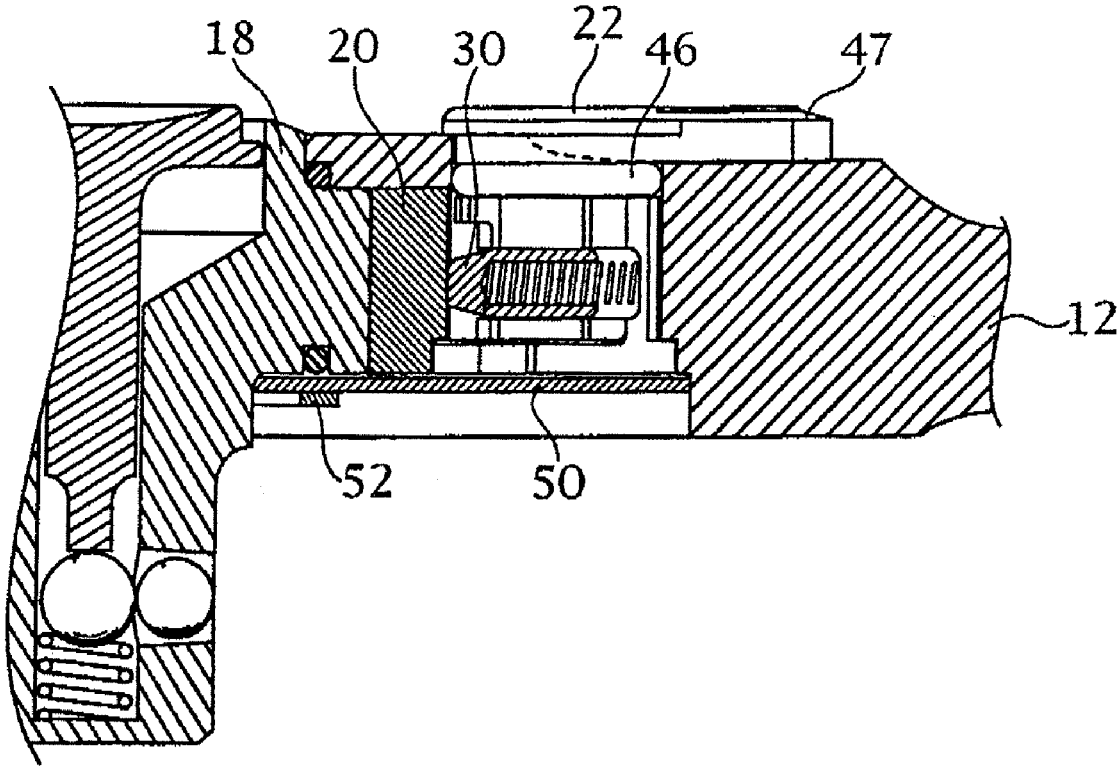
FIG. 17 is a partial cut-away view showing the cover shield and retaining ring installed.

A cover plate or shield 50 is disposed on a shelf 51 recessed on the underside of the head 14 peripherally around the through opening 16. The cover plate 50 is spaced from the reversing lever 22. A retaining ring 52 removably secures the cover shield 50 to the bottom of the head 14 (FIG. 17). In this manner, the cover plate 50 serves as a dirt shield and does not retain the reversing lever 22 in the through cavity 16. The cover plate 50 and the first O-ring 46 on the reversing lever 22 prevent dirt from entering the wrench. To further prevent or reduce the ingress of dirt into the wrench 10, a second O-ring is disposed on the top of the ratchet gear 18 in a counterbore formed therein. Also, a third O-ring 56 is disposed in a groove formed in the bottom of the ratchet gear 18 wherein a seal is formed between the third O-ring 56 and the cover plate 50.

The wrench 10 has successfully passed very severe drop testing on a concrete surface.

Obviously, many modifications may be made without departing from the basic spirit of the present invention. Accordingly, it will be appreciated by those skilled in the art that within the scope of the appended claims, the invention may be practiced other than has been specifically described herein.

What is claimed:

1. A ratcheting tool, said ratcheting tool comprising:

a. a head and a handle attached to said head, said head having a top end and an open bottom end, said open bottom end including a shelf disposed around its periphery;

b. a through cavity defined in said head;

c. a gear disposed in said through cavity distal from said handle, said gear defining a first plurality of teeth on an outer circumference thereof;

d. a pawl disposed in said through cavity intermediate said gear and said handle so that said pawl is slidable laterally across with respect to said gear between a first position in which said pawl is disposed between said head and said gear so that said head transmits torque through said pawl in a first rotational direction, and a second position in which said pawl is disposed between said head and said gear so that said head transmits torque through said pawl in an opposite rotational direction, said pawl defining a second plurality of teeth on a front face of said pawl for engaging said first plurality of teeth, said front face extending between a top and a bottom end of said pawl, a recessed portion defined by a concave surface in a back face of said pawl, a ledge formed adjacent a lower surface of said pawl bottom end;

e. a reversing lever disposed in said through cavity intermediate said pawl and said handle, said reversing lever being in driving engagement with said pawl so that actuation of said reversing lever drives said pawl between said first position and said second position, said reversing lever defining a first lip protruding therefrom that engages said pawl ledge; and f. a cover plate disposed on said shelf of said bottom end of said head, said cover plate being beneath and spaced apart from a bottom end of said reversing lever along an axis transverse to a longitudinal center axis of said handle, wherein said top end of said pawl abuts an inside surface of said top end of said head, thereby precluding upward movement of said reversing lever out of said through cavity, and wherein said pawl moves both parallel and perpendicular to a longitudinal center axis of said handle when ratcheting occurs.

2. The ratcheting tool of claim 1, said ratcheting tool further comprising a spring loaded pusher disposed in said reversing lever, said spring-loaded pusher engaging said pawl recessed portion above said pawl ledge.

3. The ratcheting tool of claim 2, said reversing lever further comprising a blind bore, said blind bore receiving said spring-loaded pusher.

4. The ratcheting tool of claim 1, wherein said reversing lever has a front portion that is cut away to accommodate the insertion of said reversing lever into said through cavity from said top end of said head.

5. The ratcheting tool of claim 2, wherein said spring-loaded pusher has a substantially conical tip that is received by said pawl recessed portion proximate said pawl ledge.

6. A ratcheting tool, said ratcheting tool comprising:

a. a head and a handle attached to said head, said head having a top end and an open bottom end, said open bottom end including a shelf disposed around its periphery;

b. a gear rotatably disposed in said head, said gear defining a first plurality of teeth on an outer circumference thereof;

c. a pawl disposed in said head so that said pawl is slidable laterally across with respect to said gear between a first position in which said pawl is disposed between said head and said gear so that said head transmits torque through said pawl in a first rotational direction, and a second position in which said pawl is disposed between said head and said gear so that said head transmits torque through said pawl in an opposite rotational direction, said pawl defining a second plurality of teeth on a front face of said pawl for engaging said first plurality of teeth, said front face extending between a top and a bottom end of said pawl, a recessed portion disposed in a back face of said pawl, said recessed portion being defined by a concave surface, and a ledge formed adjacent a lower surface of said pawl bottom end, wherein said pawl bottom end extends between said pawl front face and said pawl back face, wherein said recessed portion extends between said pawl top end and said pawl ledge, and d. a reversing lever disposed in said head in driving engagement with said pawl so that actuation of said reversing lever drives said pawl between said first position and said second position, said reversing lever defining a first lip protruding therefrom that is received by said pawl ledge; and e. a cover plate disposed on said shelf of said bottom end of said head, said cover plate being beneath and spaced apart from a bottom end of said reversing lever along an axis transverse to a longitudinal center axis of said handle, wherein said top end of said pawl abuts an inside surface of said top end of said head, thereby precluding upward movement of said reversing lever out of said through cavity, and wherein said pawl moves both parallel and perpendicular to a longitudinal center axis of said handle when ratcheting occurs.

7. The ratcheting tool of claim 6, said ratcheting tool further comprising a pusher and a spring disposed in said reversing lever, said pusher engaging said pawl recessed portion above said pawl ledge.

8. The ratcheting tool of claim 7, said reversing lever further comprising a blind bore, said blind bore receiving said pusher and spring.

9. The ratcheting tool of claim 6, wherein said reversing lever has a recessed front portion to accommodate the insertion of said reversing lever into said head from said head top end.

10. The ratcheting tool of claim 7, wherein said pusher has a substantially conical tip that is received by said pawl recessed portion proximate said pawl ledge.

11. A ratcheting tool, said ratcheting tool comprising:

a. a head and a handle attached to said head, said head having a top end, a bottom end, and an inner wall defining a first ledge;

b. a gear rotatably disposed in said head, said gear defining a first plurality of teeth on an outer circumference thereof;

c. a pawl disposed in said head so that said pawl is slidable laterally across with respect to said gear between a first position in which said pawl is disposed between said head and said gear so that said head transmits torque through said pawl in a first rotational direction, and a second position in which said pawl is disposed between said head and said gear so that said head transmits torque through said pawl in an opposite rotational direction, said pawl defining a second plurality of teeth on a front face of said pawl for engaging said first plurality of teeth, said front face extending between a top and a bottom end of said pawl, a recessed portion disposed in a back face of said pawl, and a second ledge formed adjacent a lower surface of said pawl bottom end, wherein said recessed portion extends between said pawl top end and said pawl second ledge, and d. a reversing lever disposed in said head in driving engagement with said pawl so that actuation of said reversing lever drives said pawl between said first position and said second position, said reversing lever defining a first lip and a second lip protruding therefrom, said second lip being received by said second ledge of said pawl and said first lip being received by said first ledge of said head, wherein said top end said pawl abuts an inside surface of said head, thereby precluding upward movement of said reversing lever out of said through cavity.

* * * * *